US006911909B2

(12) United States Patent
Chandar

(10) Patent No.: US 6,911,909 B2
(45) Date of Patent: Jun. 28, 2005

(54) LIGHT SENSING HIDDEN OBJECT LOCATION SYSTEM

(75) Inventor: Ravi Chandar, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3 days.

(21) Appl. No.: 10/443,180

(22) Filed: May 21, 2003

(65) Prior Publication Data

US 2003/0197610 A1 Oct. 23, 2003

Related U.S. Application Data

(63) Continuation of application No. 09/894,141, filed on Jun. 29, 2001, now Pat. No. 6,590,497.

(51) Int. Cl.[7] ..... G08B 13/14
(52) U.S. Cl. ..... 340/571; 340/568.1
(58) Field of Search ..... 340/568.1, 572.1, 340/572.4, 572.6, 571, 522, 555, 683, 687, 5.62; 362/100, 155, 802

(56) References Cited

U.S. PATENT DOCUMENTS

| | | | | |
|---|---|---|---|---|
| 4,101,876 A | | 7/1978 | Lurkis et al. | |
| 4,872,095 A | | 10/1989 | Dubak et al. | |
| 5,068,643 A | | 11/1991 | Yashina | |
| 5,541,585 A | * | 7/1996 | Duhame et al. | 340/5.62 |
| 5,552,837 A | | 9/1996 | Mankovitz | |
| 5,677,675 A | | 10/1997 | Taylor et al. | |
| 5,918,960 A | | 7/1999 | Hopwood et al. | |
| 5,926,090 A | | 7/1999 | Taylor et al. | |

* cited by examiner

*Primary Examiner*—Van T. Trieu

(57) ABSTRACT

An object locating system for automatically locating a hidden or lost wireless object. This is applicable to objects such as remote controls for TVs and VCRs and the like. An ambient light photosensor is located on the object. The object locating system also includes an alarm located on the wireless object, which is electrically connected to the ambient light photosensor. The ambient light photosensor senses ambient lighting conditions. The alarm is actuated when the ambient light photosensor detects ambient light below a predetermined level.

42 Claims, 6 Drawing Sheets

LIGHT SENSING HIDDEN OBJECT LOCATION SYSTEM

This application is a continuation of U.S. patent application Ser. No. 09/894,141, now U.S. Pat. No. 6,590,497, entitled "LIGHT SENSING HIDDEN OBJECT LOCATION SYSTEM", by Ravi Chandar, filed Jun. 29, 2001. U.S. patent application Ser. No. 09/894,141 is hereby fully incorporated herein by reference.

FIELD OF THE INVENTION

This invention relates generally to a locating system for locating lost or hidden objects such as a television remote control device, and more particularly, a system for finding lost or hidden objects when lighting is reduced.

BACKGROUND FOR THE INVENTION

Remote control devices are well known for the operation of electronic devices such as audio and/or video equipment, e.g. television (TV) sets, video recorders (VCR), cable boxes, and compact disc (CD) players. Because remote control devices are conveniently portable, they allow users to operate electronic devices from remote locations. Often a user would misplace a remote control and not remember where he left it. Usually these devices are lost between cushions of a sofa, under magazines, or blankets, or articles of clothing, depending on where the remote control device is being used. In other words, these remote control devices are often lost in dark areas where they are not in plain view, and therefore difficult to find.

Problems associated with finding these devices have been addressed in the prior art. The most common types of locating devices have detectors that have to be activated in order to be found. Typically, a user who has misplaced his remote control would activate some sort of transmitter usually located on the parent appliance (TV set or CD player etc). A receiver located in the remote control receives the transmitted signal. The reception of this signal triggers some sort of alarm on the remote control device, thereby enabling the user to find it.

A possible disadvantage associated with such a remote control locating device is that the locating function cannot operate in an automatic mode. In order to locate the misplaced remote, the user must first trigger the locating system. Another disadvantage is that these systems require extra components, such as the transmitter attached to the parent device, which can be costly.

Another known type of remote control locator device is the "clapper". When the user has discovered that the device is missing, he activates an alarm in the remote control device by clapping his hands. This enables him to locate the remote control. Some of these remote control devices may also be voice responsive. Similar to the other devices, a disadvantage associated with these devices is that they cannot be operated in an automatic mode. In order to locate the misplaced remote, the user must trigger the locating system. Input such as clapping is required by the person looking for the remote.

SUMMARY OF THE INVENTION

In one respect, the invention is a method for locating a hidden object This method involves several steps. One step is the sensing an ambient light level in the near proximity of the object. Another step is the determination of whether the light level is below a predetermined level. Another step in this method is the activation of an alarm connected to the object, in response to the determination step.

In another respect, the invention is a device to aid in locating an object. In this respect, the device comprises an ambient light sensor that is connectable to the object. The device also comprises an alarm that is electrically connected to the ambient light sensor. The alarm is activated when the ambient light detector senses light at a level that is below a predetermined level.

In this respect, the device may be divided into parts including, a first part and a second part. In this respect, the first part may consist of a first power source, a transistor, and the ambient light sensor. In this respect, the second part may consist of a second power source and the alarm. The system may also include an electro-magnetic relay that electrically connects the first part to the second part. The electromagnetic relay may be connected to actuate the alarm when the ambient light photosensor senses light at a level below the predetermined level.

In another respect, the invention is a system to aid in locating an object. In this respect, the system comprises an object and an ambient light sensor that is connected to the object. The system also includes an alarm that is electrically connected to the ambient light sensor. The alarm according to this invention is activated when the ambient light detector senses light at a level that is below a predetermined level.

In this respect, the system to aid in locating an object may be divided into parts including, a first part and a second part. In this respect, the first part may consist of a first power source, a transistor, and the ambient light sensor. In this respect, the second part may consist of a second power source and the alarm. The system may also include an electro-magnetic relay that electrically connects the first part to the second part. The electro-magnetic relay may be connected to actuate the alarm when the ambient light photosensor senses light at a level below a predetermined level.

In comparison to known prior art, certain embodiments of the invention are capable of achieving certain advantages. One advantage is the economy of parts associated with this device. The locating system is wholly independent of the parent device, and therefore does not require any additional elements in the parent device, such as transmitters etc. Another advantage is the use of a photosensor, which senses ambient conditions and reacts automatically to being placed in concealed locations. These and other advantages will be apparent to those skilled in the art upon reading the following detailed description of preferred embodiments, with reference to the below listed drawings.

DETAILED DESCRIPTION OF THE PREFERRED EMBODIMENTS

Figure 1:
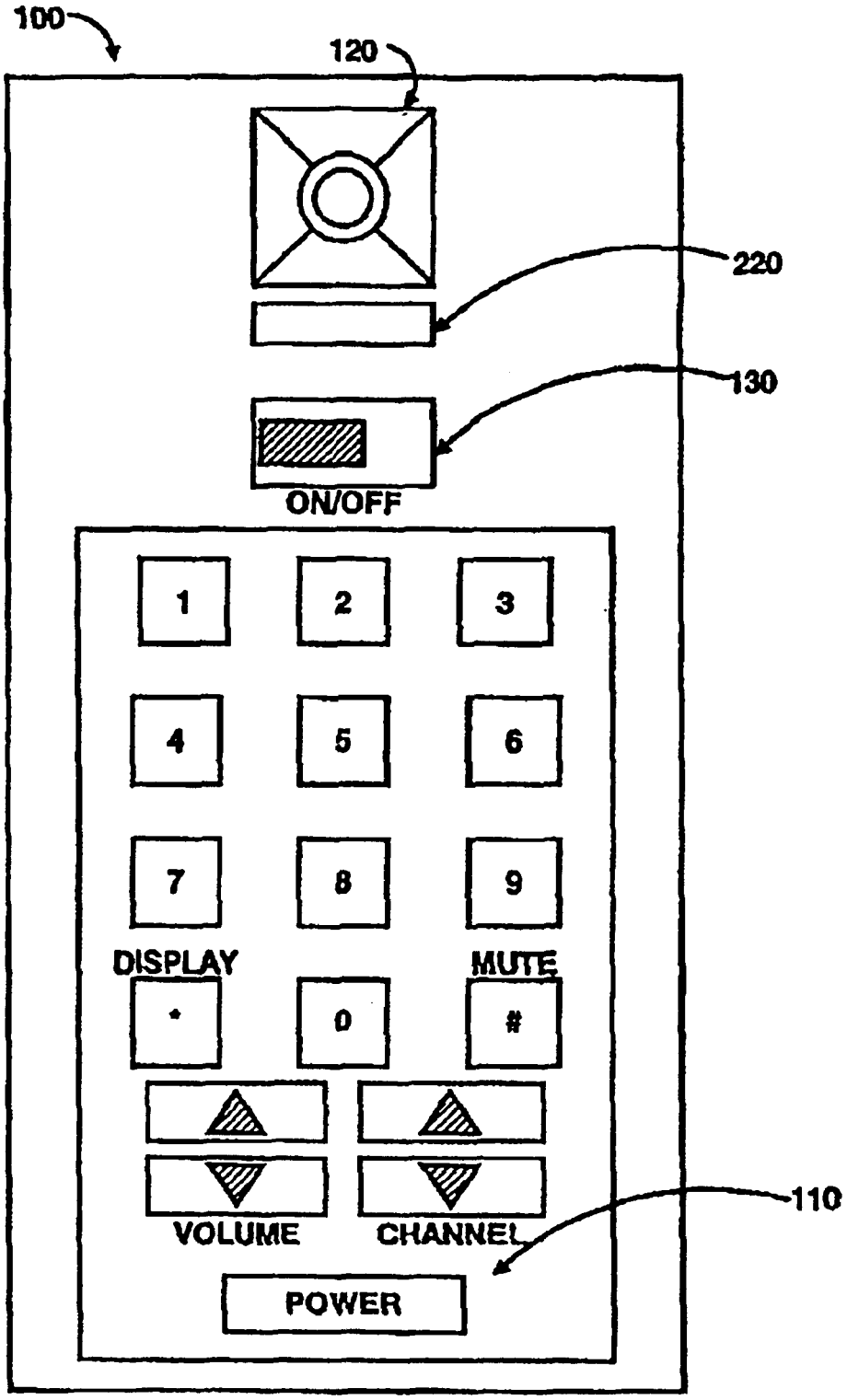
FIG. 1 shows a wireless object according to a first embodiment.

FIG. 1 shows a wireless object 100 according to a first embodiment. This wireless object 100 may be a remote control device for operating a parent electronic appliance The parent appliance may be a TV or a CD player or the like. As illustrated in FIG. 1, the wireless object has a control panel 110 that includes control buttons for operating the object related functions. FIG. 1 also illustrates an alarm 120 that is located on the wireless object 100. This alarm 120 may be a beeper, and upon actuation, may produce an audio signal to notify the user of its location. Also illustrated in FIG. 1 is an ON/OFF switch 130. This switch 130 is used to disconnect the alarm 120, when the locating service is not desired. FIG. 1 also illustrates an ambient light photosensor 220. The photosensor 220 is preferably located on an upper face of the wireless object, i.e., the face of the device that has the control panel 110, the alarm 120, and the ON/OFF switch 130. However, the photosensor 220 may be fitted on any other surface of the object without deviating from the scope and spirit of the present invention.

Figure 2:
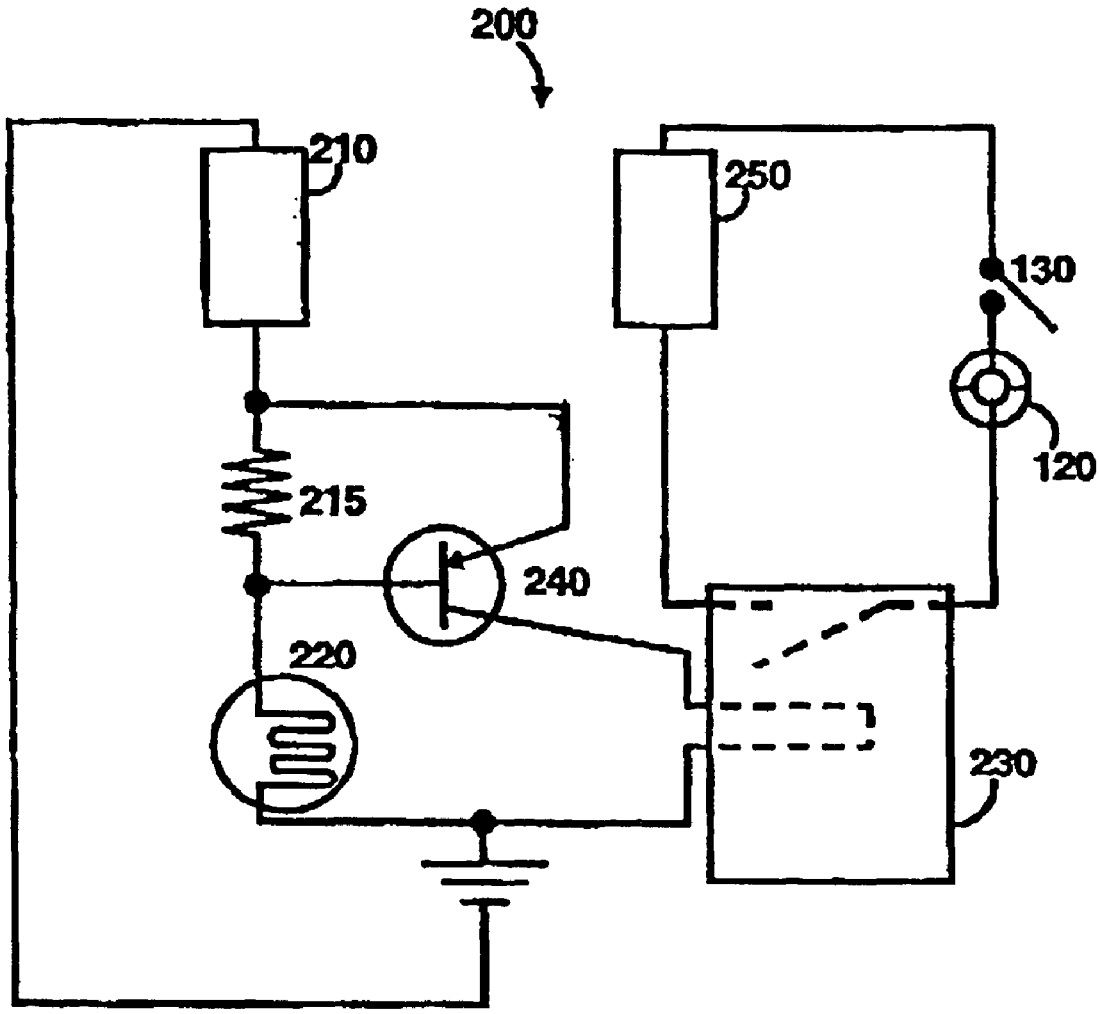
FIG. 2 shows the circuitry of a wireless object locating system.

FIG. 2 shows the circuitry of a wireless object locating system 200. The system 200 has a first power source 210, a resistor 215, a photosensor 220, and an electro-magnetic relay 230. This system may also include a transistor 240. FIG. 2 shows a second power source 250. FIG. 2 also shows the alarm 120 and the ON/OFF switch 130, which were already illustrated in FIG. 1. The system 200 can be divided into two parts, Part A and Part B, as illustrated in FIGS. 3A and 3B.

Figure 3A:
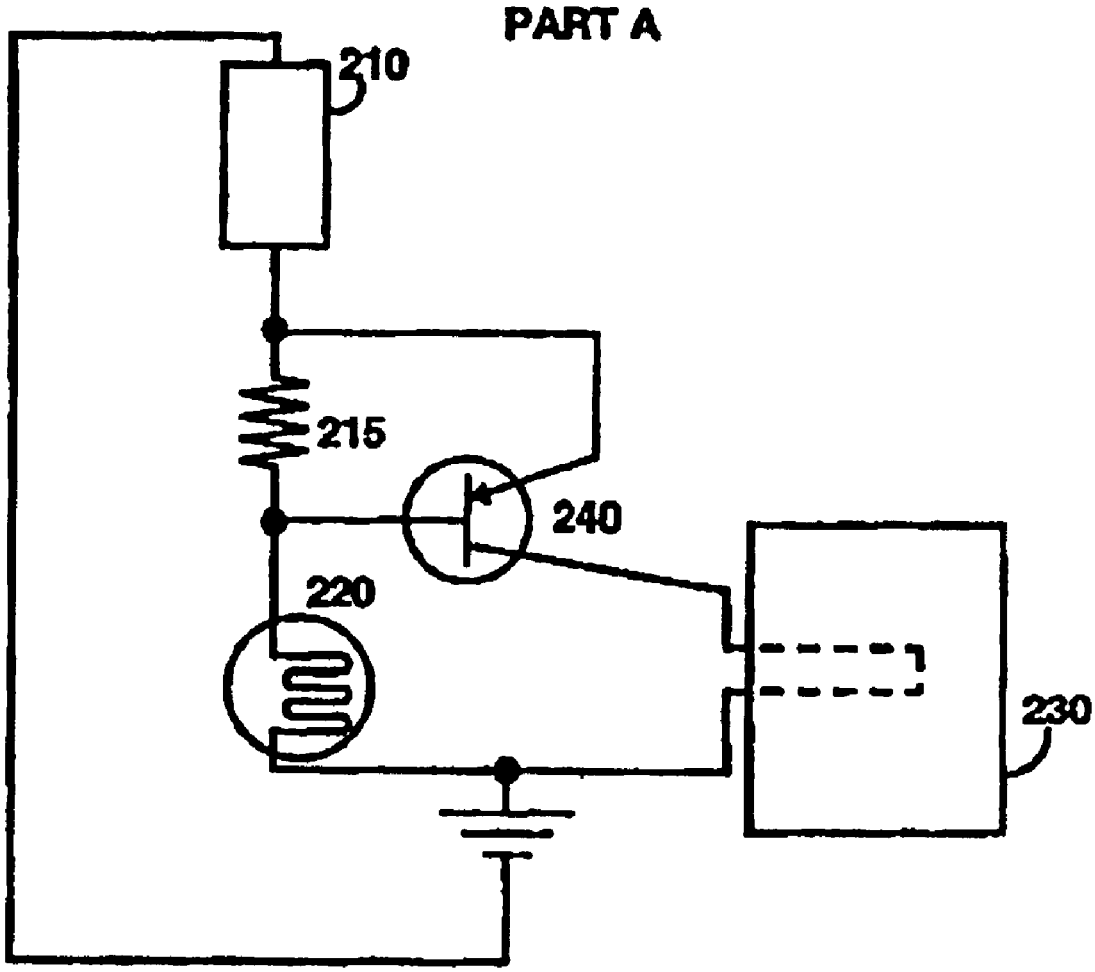
FIG. 3A shows the Part A components of the circuitry of FIG. 2.

FIG. 3A shows the Part A components of the circuitry of the wireless object locating system 200. Part A includes the power source 210 that may be a conventional battery. The power source 210 is connected to the photosensor 220, which may be a photocell, such as a cadmium sulphide photo resistor. The photosensor 220 detects ambient light. The photocell operates in such a way that its resistance changes according to the amount of light that shines on it. The resistance of the photocell is inversely proportional to the light detected. As a result, current passing through the photocell 220 from the battery 210 changes in direct proportion to the amount of light shining on the photosensor 220.

FIG. 3A also shows the electromagnetic relay 230. The electro-magnetic relay 230 is the element that electrically couples Parts A and B of the system 200. With respect to Part A, the electro-magnetic relay 230 is electrically coupled to the photosensor 220. The current flowing from the photosensor 220 activates the electro-magnetic relay 230. Part A may also include a transistor 240 in conjunction with the photosensor 220. This transistor 240 may be necessary because the photocell may not be able to draw enough current to activate the electro-magnetic relay 230. The transistor 240 is used to amplify the current.

Figure 3B:
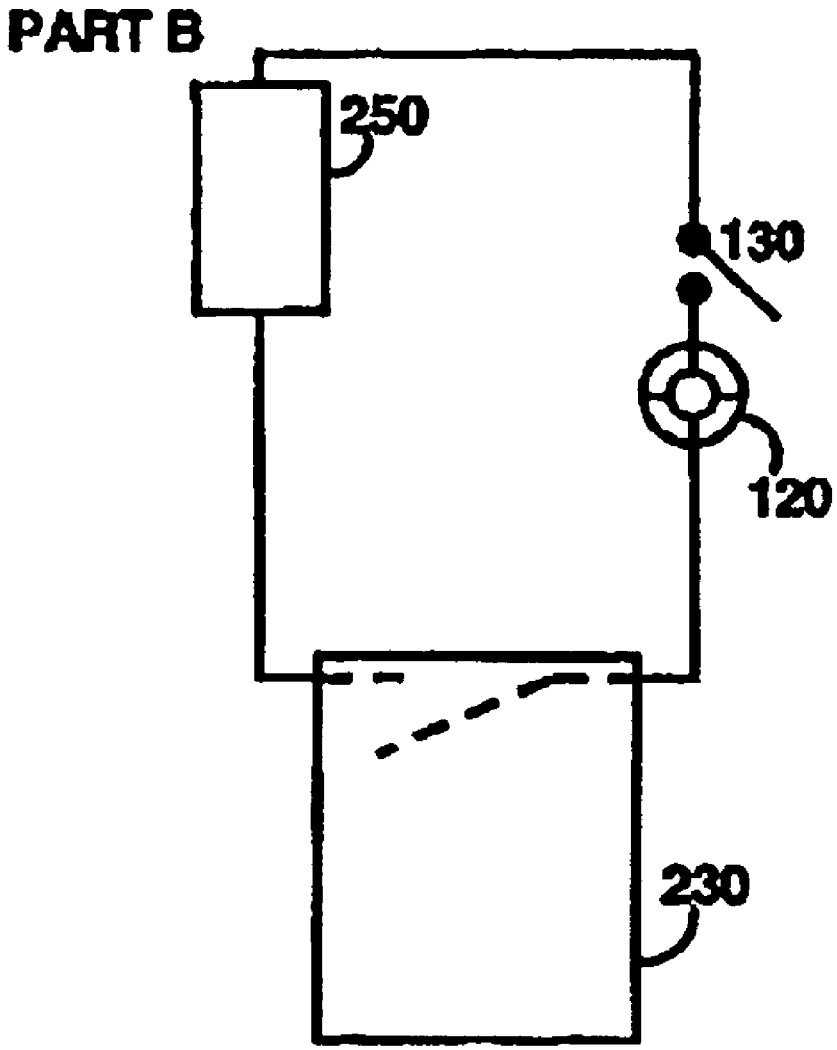
FIG. 3B shows the Part B components of the circuitry of FIG. 2.

FIG. 3B shows the Part B components of the circuitry of the wireless object locating system 200. Part B includes the alarm 120 and the ON/OFF switch 130. The ON/OFF switch 130 is also connected to the second power source 250. According to the switch setting, the power to the alarm 120 can be turned OFF or turned ON. The default setting is preferably ON. This is achieved by having the switch 130 closed. However, the power to the alarm 120 can also be turned OFF. The alarm 120 can be turned OFF in one of two ways. First, a user using the ON/OFF switch 130 could disconnect the alarm 120 from the power source 250. The alarm 120 could also be disengaged by the electro-magnetic relay 230, as will be described in reference to FIG. 4.

Figure 4:
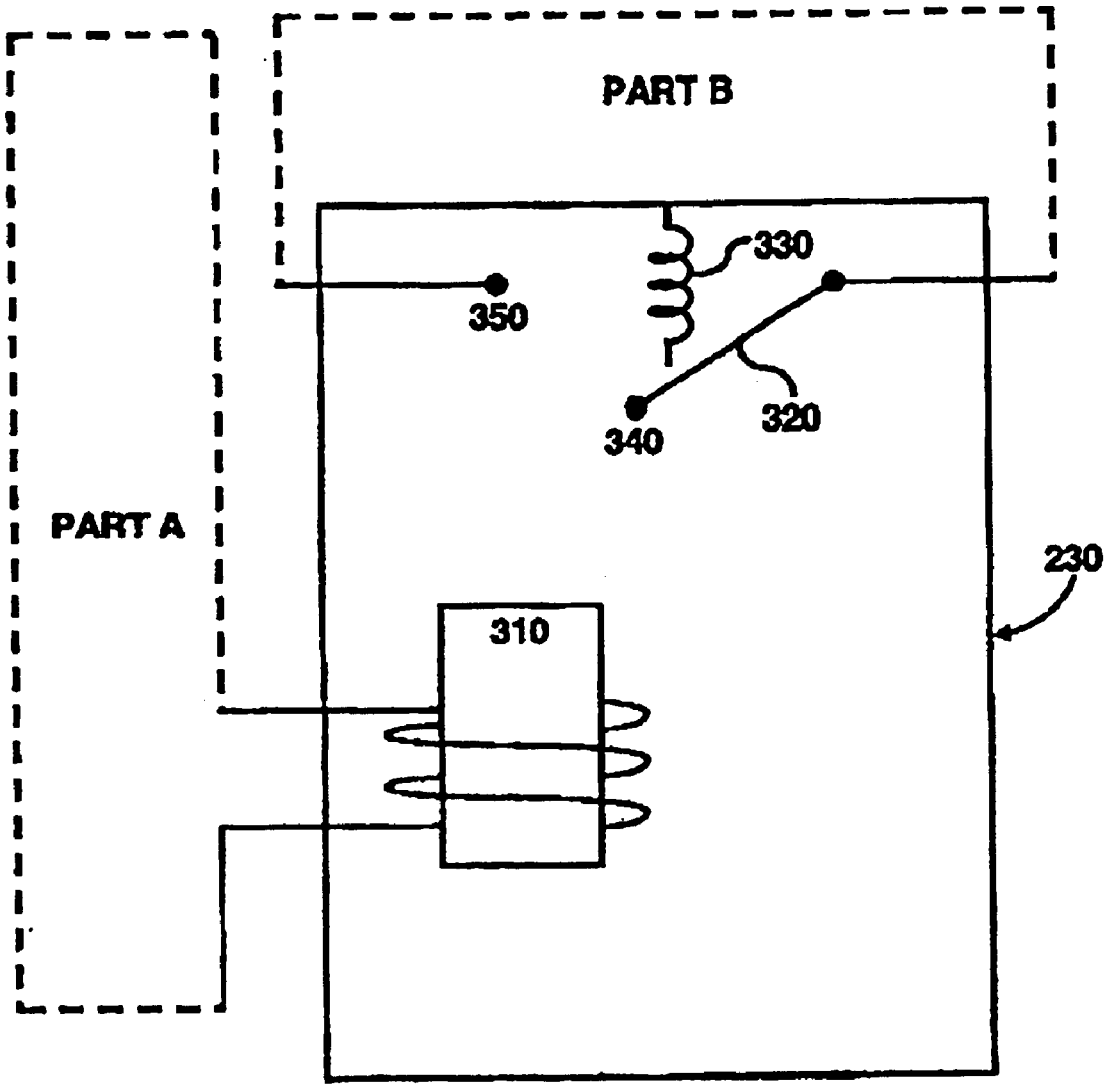
FIG. 4 shows the components of the electro-magnetic relay of FIG. 2.

FIG. 4 shows the components of the electro-magnetic relay 230. Also, FIG. 4 schematically shows the connections to Parts A and B. As illustrated in FIG. 2, the electro-magnetic relay 230 is the element that couples Parts A and B of the locating system 200. As illustrated in FIG. 4, the electro-magnetic relay 230 includes an electromagnet 310. The relay system also includes a movable armature 320, which is biased by a spring 330. FIG. 4 also shows a pair of contacts 340 and 350. The electro-magnetic relay 230 may be used to connect and to disconnect the alarm circuit. When a sufficiently strong current is flowing through the relay 230, the electromagnet 310 becomes energized. This current is the output current from Part A. When the electromagnet 310 becomes energized, the armature 320 is attracted towards the electromagnet 310 and the armature 320 engages the contact 340. The effect of this is to keep the alarm circuit in an open or disengaged state. When no current flows or the current is sufficiently low, the electromagnet 310 is not energized and the biasing force of the spring 330 pulls the armature 320 away from the electromagnet 310, bringing it into engagement with the contact 350. This closes/engages the alarm circuit in Part B.

The general operation of the locating system is as follows. When the photosensor 220 detects a sufficient amount of light, the cell has almost no resistance. Therefore it conducts electricity freely. In this instance, the electromagnet 310 is energized. As a result, the armature 320 is attracted by the electromagnet 310, brining it into engagement with the contact 340. As explained above, this causes the alarm circuit to open. As a result, no alarm is produced.

When no light shines on the photosensor 220, the resistance becomes high, thereby restricting the flow of electricity to almost zero. Because of the inadequate flow of electricity, the electro-magnet 310 is not energized, and the biasing force of the spring 330, pulls the armature 320 away from the electromagnet 310 and into engagement with the contact 350. In effect, this closes the alarm circuit and activates the alarm 120. As stated above, the photosensor 220 is located on the upper surface of the object 100. Therefore, a "no-light" condition sensed is usually indicative of a situation where the object is covered or hidden.

Figure 5:
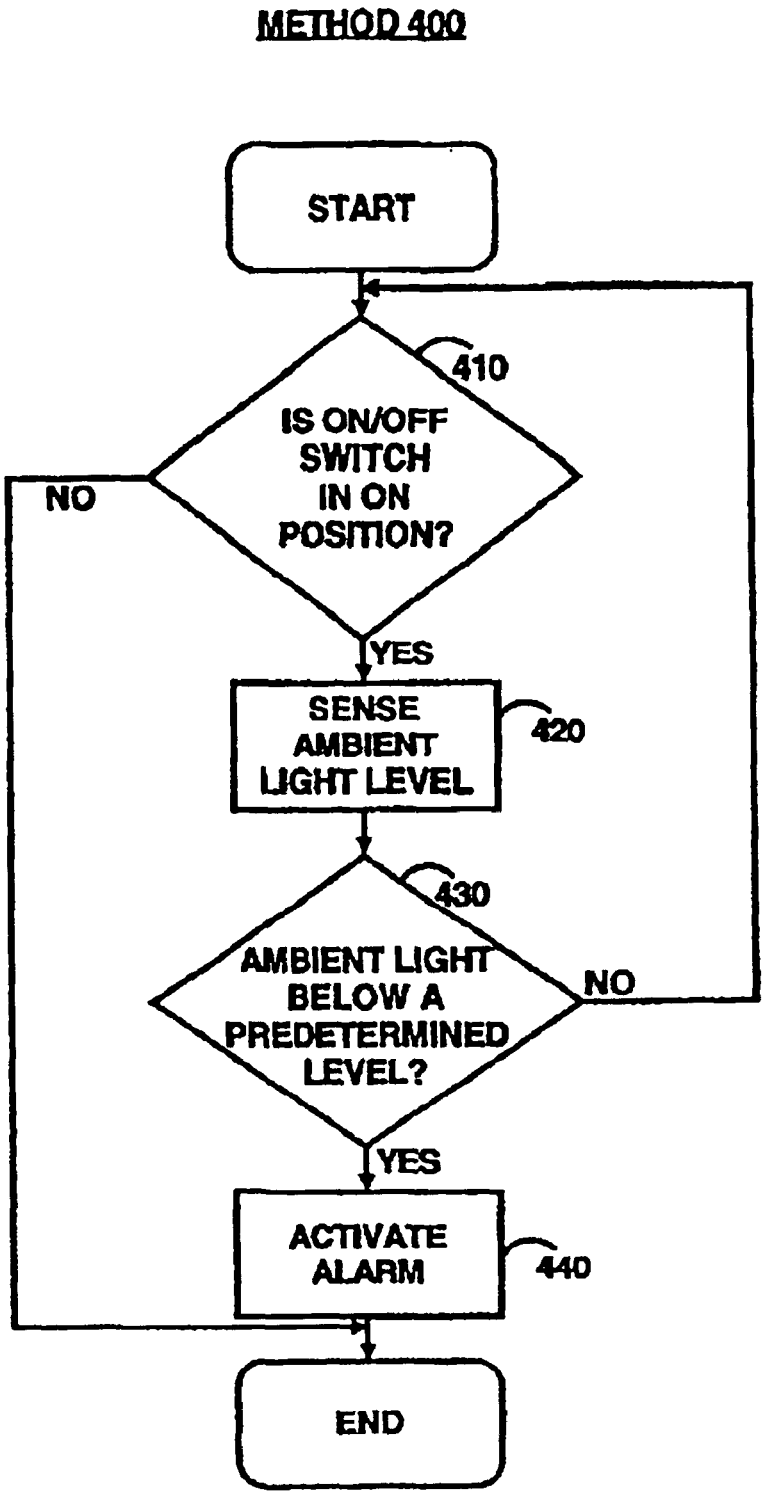
FIG. 5 is a flowchart of a method according to an embodiment of the invention.

FIG. 5 is a flowchart of a method 400 according to an embodiment of the invention. This figure out lines the steps performed by the wireless object locating system 200 in locating a wireless object 100. As illustrated in FIG. 5, after the process has started, the wireless object locating system 200 goes through a decision stage 410. At this decision stage 410, the position of the ON/OFF switch 130 is considered. If the switch 130 is in the OFF (open) position, then the entire process ends because in the OFF position, the alarm 120 is disengaged. If, however, the switch 130 is the ON (closed) position, the next stage 420 is the sensing of the ambient light. This is performed by the ambient light photosensor 220, which is preferably positioned on the upper face of the wireless object 100. After the ambient light has been sensed, the next stage is a decision stage 430. At this stage, it is decided if the ambient conditions are too dark, i.e., if the ambient light is below a predetermined level. If the answer is NO, then wireless object locating system 200 re-starts the process and repeats step 410 and the relevant subsequent steps. If the decision at stage 430 is YES, i.e., the ambient lighting is too dark, i.e., if the ambient light is below a predetermined level, then the alarm 120 is activated in step 440. This ends the process.

With respect to the predetermined level of light, it should be noted that a predetermined level of light might be any chosen level of light in a lighting spectrum that ranges from absolute darkness to visible light. This predetermined level can be varied to any desired level. For most users, the predetermined level would be closer to the absolute darkness portion of the spectrum. However, in the case of a visually impaired user, the predetermined level may be closer to the visible light portion of the spectrum. The light level at which the alarm is activated may be altered by adjusting the strengths of the electromagnet 310 and/or the strength of the spring 330.

In the vast majority of cases, the predetermined level is not a parameter that demands exact determination. The predetermined level is simply a threshold level that distinguishes the relatively well-lit condition to which the object 100 is typically exposed when uncovered, from the relatively dark condition to which the object 100 is typically exposed when covered. Those skilled in the art can easily conduct an experiment to measure these two extreme conditions and pick any level intermediate to these extremes.

The wireless object locating system 200 may be integrated with the wireless object 100 as illustrated in FIG. 1. In other words, the wireless object locating system 200 may be formed as an integral part of the wireless object 100 during the manufacture of the wireless object 100. The wireless object locating system 200 may also be attached or retrofitted onto the wireless object 100 subsequent to the manufacture of the wireless object 100. In the case of a remote control device, the object locating system 200 may be incorporated with the remote control device at the manufacturing stage, or the object locating system 200 may be retrofitted to a pre-existing remote control device.

With respect to the alarm 120, it has already been stated that the alarm may be a noisemaker such as a beeper that upon activation may produce an audio signal. In addition to a noisemaker, the alarm 120 may be any known type that is applicable to this invention. For instance, the alarm 120 may be a flasher that may preferably emit bright light. Preferably the flasher is located on a surface different from that of the photosensor 220. The light emitted would enable a user to locate the lost object 100. The alarm 120 may also be a vibrator that signals a user by vibrating. The alarm 120 may also be a beacon signal (radio frequency) transmitter that may produce a "lost" signal to a user via a receiver of some type. The receiver may be in a separate device. In the case where the lost wireless object 100 is a remote control device, the receiver may be located in the parent appliance.

What has been described and illustrated herein are preferred embodiments of the invention along with some variations. The terms, descriptions and figures used herein are set forth by way of illustration only and are not meant as limitations. For instance, the remote control device may be for the operation of other devices other than those mentioned specifically herein. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A method for locating a hidden object, the method comprising:

sensing an ambient light level in the near proximity of the object;

determining if the light level is below a predetermined level; and activating an alarm capable to be coupled to the object, in response to the light level is below the predetermined level, wherein the alarm is activated by an electro-magnetic circuit comprising an electromagnet and an armature capable of being placed in contact with said electromagnet.

2. The method of claim 1 wherein the sensing step comprises sensing an ambient light level at an upper surface of the object.

3. The method of claim 1 wherein the alarm is one or more selected from the group consisting of a noisemaker, a light emitter, a vibrator, and a radio signal transmitter.

4. The method of claim 1 wherein the object is a remote control device.

5. The method of claim 1 wherein the sensing of the ambient light is performed with a photosensor, and the alarm is triggered by the photosensor activating the alarm via the electro-magnetic circuit.

6. The method of claim 1 wherein a switch is used to electrically disengage the alarm.

7. The method of claim 1, wherein the alarm is activated by an electromagnetic circuit coupled to the object.

8. The method of claim 1, wherein the armature biased by a spring.

9. A device to aid in locating an object, the device comprising:

an ambient light sensor capable to be coupled to the object; and an alarm capable to be electrically coupled to the ambient light sensor, wherein the alarm is activated when the ambient light detector senses light at a level below a predetermined level, and wherein the alarm is activated by an electro-magnetic circuit comprising an electromagnet and an armature capable of being placed in contact with said electromagnet.

10. The device of claim 9, wherein the device is divided into parts including a first part and a second part, the first part comprising:

a first power source, a transistor, and the ambient light sensor.

11. The device of claim 10 wherein the second part comprises:

a second power source and the alarm.

12. The device of claim 11, the device further comprising:

an electro-magnetic circuit, the electro-magnetic circuit electrically connecting the first part to the second part, the electro-magnetic circuit connected to activate the alarm when the ambient light photosensor senses light at a level below a predetermined level.

13. The device of claim 12 further comprising:

a switch in the second part electrically connected to the second power source, for deactivating the locating device.

14. The device of claim 12 wherein the alarm is one or more selected from the group consisting of a noisemaker, a light emitter, a vibrator, and a radio signal transmitter.

15. The device of claim 12 wherein the ambient light photosensor is a cadmium sulphide photoresistor.

16. The device of claim 9, wherein the alarm is activated by an electromagnetic circuit coupled to the object.

17. The device of claim 9, wherein the armature biased by a spring.

18. A system to aid in locating an object, the system comprising:

an object;

an ambient light sensor capable to be coupled to the object;

an alarm capable to be electrically coupled to the ambient light sensor, wherein the alarm is activated when the ambient light detector senses light at a level below a predetermined level; and an electro-magnetic circuit configured to activate the alarm, the electro-magnetic circuit comprising an electromagnet and an armature capable of being placed in contact with said electromagnet.

19. The system of claim 18, wherein the system is divided into parts including a first part and a second part, the first part comprising:

a first power source, a transistor, and the ambient light sensor.

20. The system of claim 19 wherein the second part comprises:

a second power source and the alarm.

21. The system of claim 20, the system further comprising:

an electro-magnetic relay, the electro-magnetic relay electrically connecting the first part to the second part, the electro-magnetic relay connected to activate the alarm when the ambient light photosensor senses light at a level below a predetermined level.

22. The system of claim 21 further comprising:

a switch in the second part electrically connected to the second power source, for deactivating the locating system.

23. The system of claim 21 wherein the alarm is one or more selected from the group consisting of a noisemaker, a light emitter, a vibrator, and a radio signal transmitter.

24. The system of claim 21 wherein the ambient light photosensor is a cadmium sulphide photosensor.

25. The system of claim 18, wherein the alarm is activated by an electromagnetic circuit coupled to the object.

26. The system of claim 18, wherein the armature biased by a spring.

27. A method for locating a hidden object, the method comprising:

determining if an ambient light level near a remote control device is below a predetermined level; and activating an alarm by an electromagnetic circuit capable to be coupled to the remote control device, in response to the ambient light level falling below the predetermined level, wherein the electro-magnetic circuit comprises an electromagnet, and an armature capable of being placed in contact with said electromagnet.

28. The method of claim 27, wherein the ambient light level is determined by a photosensor capable to be coupled to the remote control device.

29. The method of claim 28, wherein the photosensor passes current to activate the electro-magnetic circuit, and wherein the photosensor provides resistance inversely proportional to the determined ambient light level, the resistance changing a value of the current.

30. The method of claim 29, wherein the current is amplified by a transistor coupled to the photosensor.

31. The method of claim 27, wherein the armature is biased by a spring.

32. An apparatus for locating a hidden device, the apparatus comprising:

a remote control apparatus, comprising:

an electromagnetic circuit comprising an electromagnet, and an armature capable of being placed in contact with said electromagnet;

a photosensor; and an alarm capable to be coupled to the photosensor and the electromagnetic circuit, and configured to be activated by the electromagnetic circuit if the photosensor senses ambient light at a level below a predetermined level.

33. The apparatus of claim 32, wherein the photosensor passes current to activate the electro-magnetic circuit, and wherein the photosensor provides resistance inversely proportional to the sensed ambient light level, the resistance changing a value of the current.

34. The apparatus of claim 32, further comprising:

a transistor coupled to the photosensor and configured to amplify the current.

35. The apparatus of claim 32, wherein the armature is biased by a spring.

36. A method for locating a hidden object, the method comprising:

determining if an ambient light level near a remote control device is below a predetermined level; and activating an alarm by an electromagnetic circuit capable to be coupled to the remote control device, in response to the ambient light level falling below the predetermined level, wherein the electro-magnetic circuit comprises an electromagnet, and an armature biased by a spring and capable of being placed in contact with said electromagnet.

37. The method of claim 36, wherein the ambient light level is determined by a photosensor capable to be coupled to the remote control device.

38. The method of claim 37, wherein the photosensor passes current to activate the electro-magnetic circuit, and wherein the photosensor provides resistance inversely proportional to the determined ambient light level, the resistance changing a value of the current.

39. The method of claim 38, wherein the current is amplified by a transistor coupled to the photosensor.

40. An apparatus for locating a hidden device, the apparatus comprising:

a remote control apparatus, comprising:

an electromagnetic circuit comprising an electromagnet, and an armature biased by a spring and capable of being placed in contact with said electromagnet;

a photosensor; and an alarm capable to be coupled to the photosensor and the electromagnetic circuit, and configured to be activated by the electromagnetic circuit if the photosensor senses ambient light at a level below a predetermined level.

41. The apparatus of claim 40, wherein the photosensor passes current to activate the electro-magnetic circuit, and wherein the photosensor provides resistance inversely proportional to the sensed ambient light level, the resistance changing a value of the current.

42. The apparatus of claim 40, further comprising:

a transistor coupled to the photosensor and configured to amplify the current.

* * * * *